US005573490A

United States Patent [19]

Steinbrenner et al.

[11] Patent Number: 5,573,490

[45] Date of Patent: Nov. 12, 1996

[54] METHOD AND APPARATUS FOR ERECTING A FOLDING BOX AND FOLDING ITS CLOSURE TABS

[75] Inventors: Ralf Steinbrenner, Frankenhardt; Walter Dietrich, Weinstadt; Andreas Geiger, Althutte, all of Germany

[73] Assignee: Robert Bosch GmbH, Stuttgart, Germany

[21] Appl. No.: 391,288

[22] Filed: Feb. 21, 1995

Related U.S. Application Data

[63] Continuation of Ser. No. 130,483, Oct. 1, 1993, abandoned.

[30] Foreign Application Priority Data

Dec. 19, 1992 [DE] Germany ..... 42 43 139.5

[51] Int. Cl.[6] ..... B31B 3/80; B31B 5/78

[52] U.S. Cl. ..... 493/315; 493/316; 493/453; 493/183

[58] Field of Search ..... 493/183, 309, 493/315, 453, 465, 316

[56] References Cited

U.S. PATENT DOCUMENTS

| | | | |
|---|---|---|---|
| 3,225,666 | 12/1965 | Reimers | 493/183 |
| 3,367,247 | 2/1968 | Dubesset | 493/183 |
| 3,509,681 | 5/1970 | Sass | 53/473 |
| 3,956,976 | 5/1976 | Vogel et al. | 493/315 |
| 4,275,644 | 6/1981 | Moss | 493/183 |
| 4,537,587 | 8/1985 | Langen | 493/315 |
| 4,776,830 | 10/1988 | Fujikawa et al. | 493/183 |
| 4,857,038 | 8/1989 | Tacchini | 493/183 |
| 5,102,382 | 4/1992 | Center et al. | 493/183 |
| 5,180,355 | 1/1993 | Inoue | 493/315 |

FOREIGN PATENT DOCUMENTS 04333667 11/1990 European Pat. Off. .

*Primary Examiner*—Jack W. Lavinder
*Attorney, Agent, or Firm*—Edwin E. Greigg; Ronald E. Greigg

[57] ABSTRACT

A method and an apparatus for erecting a folding box and folding the closure flaps or ends. The apparatus has a transfer device, by which the folding boxes are withdrawn from a magazine and conveyed along a cycloidal orbit path and conveyed into a conveying device of a cartoning machine. The folder apparatus has a platelike folder element as well as two folder elements, that protrude from the apparatus into the range of motion of the closure flaps. The closure flaps are bent at right angles in the order of their disposition on the box in the direction of movement of the folding box to the folder elements and the conveying device.

7 Claims, 6 Drawing Sheets

METHOD AND APPARATUS FOR ERECTING A FOLDING BOX AND FOLDING ITS CLOSURE TABS

This is a continuation of application Ser. No. 08/130,483 filed on Oct. 1, 1993 now abandoned.

BACKGROUND OF THE INVENTION

The invention is based on a method and apparatus for erecting a folding box and folding its closure flaps, as set forth hereinafter. The closure flaps, which initially project from the side walls of the folding box in the same plane as the side walls are folded, uncovering an opening, so that the folding box can be moved with its opening as close as possible to a filling apparatus.

In a method of this type, known from U.S. Pat. No. 3,956,976, a folding box equipped with two side flaps and one cover flap is removed by a first conveyor device from a stack magazine and partly opened, along a first curved segment, with one side flap being folded at a folding deflector. Next, the folding box is taken over by a second conveyor device and on a second curved segment is transferred to a conveyor apparatus of a cartoning machine, in which the second side flap is folded at the same folding deflector. Finally, after the folding box has been opened completely, the cover flap is folded at an additional folding deflector by the insertion of this flap into the conveyor device of the cartoning machine. A disadvantage here is that the known apparatus can manipulate only folding boxes with three flaps. Since the two side tabs are folded in succession when a folding box is conveyed on separate curved segments, and the folding box moreover is transferred from one suction device of a conveyor apparatus to another, the known apparatus has a low output. Moreover, the geometry of the folding deflectors must be adapted to the particular folding box format; that is, for each folding box format, a plurality of folding deflectors must be furnished and exchanged, so that a format change requires long conversion times.

U.S. Pat. No. 3,509,681 also discloses a method for opening a folding box with four flaps, in which the four flaps, on the fully erected folding box, are folded partly by means of stationary folder elements and partly by means of moving folder elements on the rectilinear conveying path of the folding box in a cartoning machine. A disadvantage here is that the length of machines that perform the known method is great, and the drive and control of moving folder elements are complicated and expensive.

OBJECT AND SUMMARY OF THE INVENTION

The method according to the invention for erecting a folding box and folding its closure flaps has the advantage over the prior art that folding all the closing flaps takes place during the process of erecting the folding box, making the apparatus especially small in size. Since folding the closure flaps at stationary folder elements takes place in the course of movement and erection of the folding box, it is unnecessary to provide a drive for the folder elements. Moreover, folding of the closure flaps takes place continuously over the entire period of time from the removal of the folding box until its delivery to a conveyor device of a cartoning machine, so that the method has a high output.

Improvements to the method of the invention are attainable with the characteristics set forth hereinafter.

In an embodiment defined hereinafter, the flaps of a four-flap folding box are folded. The proposed method can be employed for various versions of folding boxes. An apparatus as defined for carrying out the method of the invention has the advantage that upon a format change, only a single part containing the folder elements needs to be replaced, thereby reducing the time required for conversion from one folding box format to another to a minimum.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
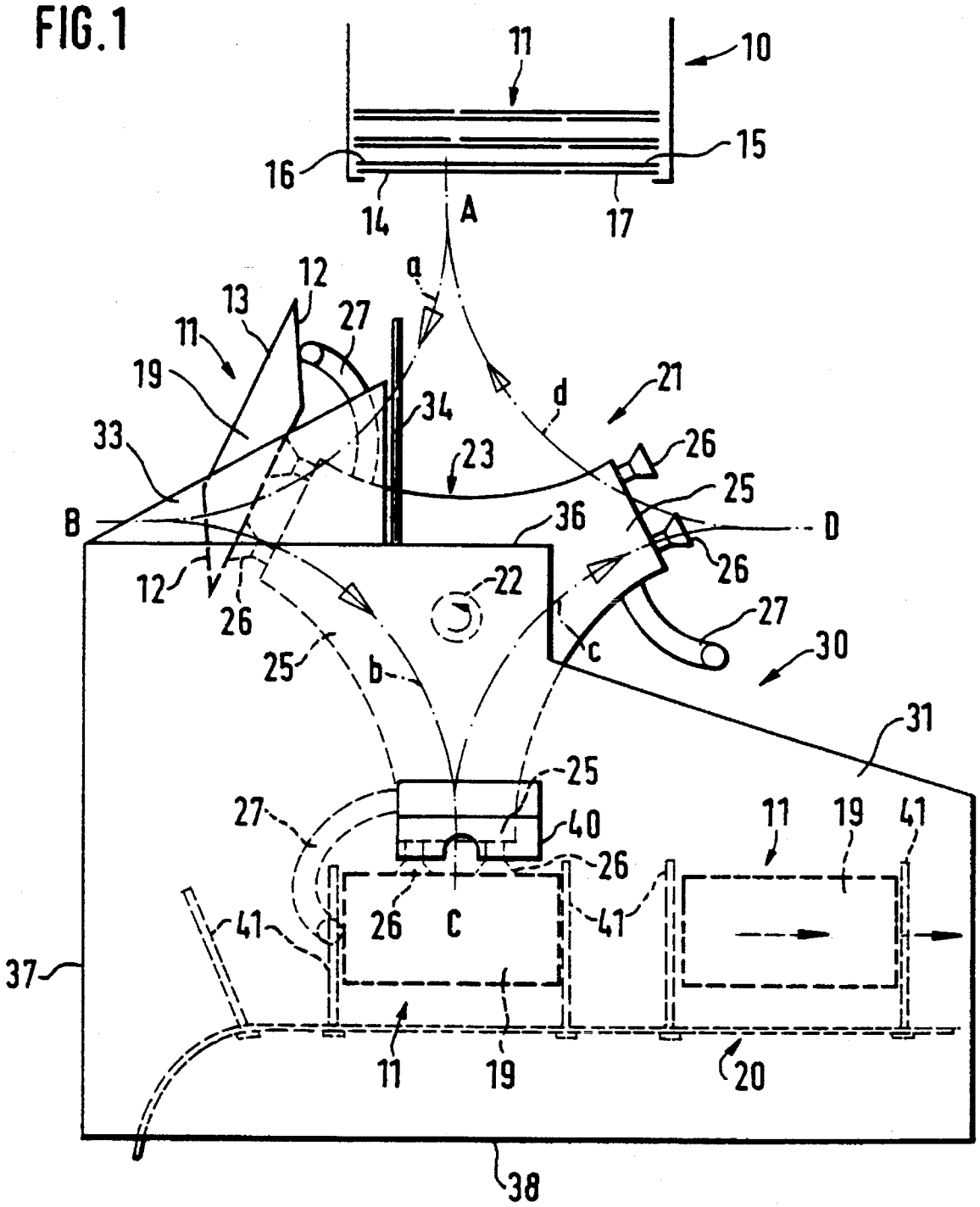
FIG. 1 shows an apparatus for erecting a folding box that has four flaps and for folding its closure flaps, in a simplified side view.
Figure 2:
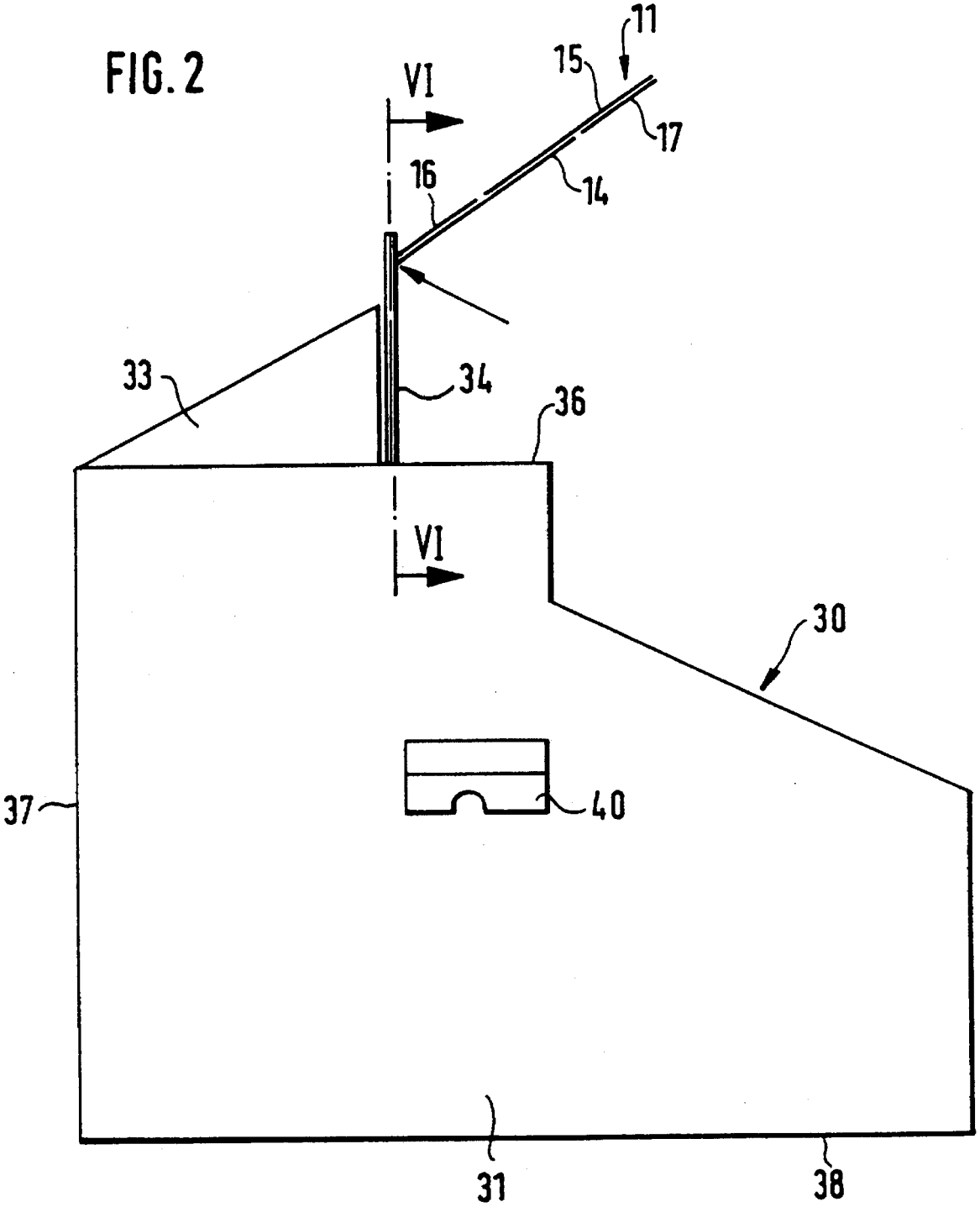
FIGS. 2–5 show an apparatus of FIG. 1 in a simplified side view during various phases in the transfer of a folding box and the folding of its closure flaps.
Figure 3:
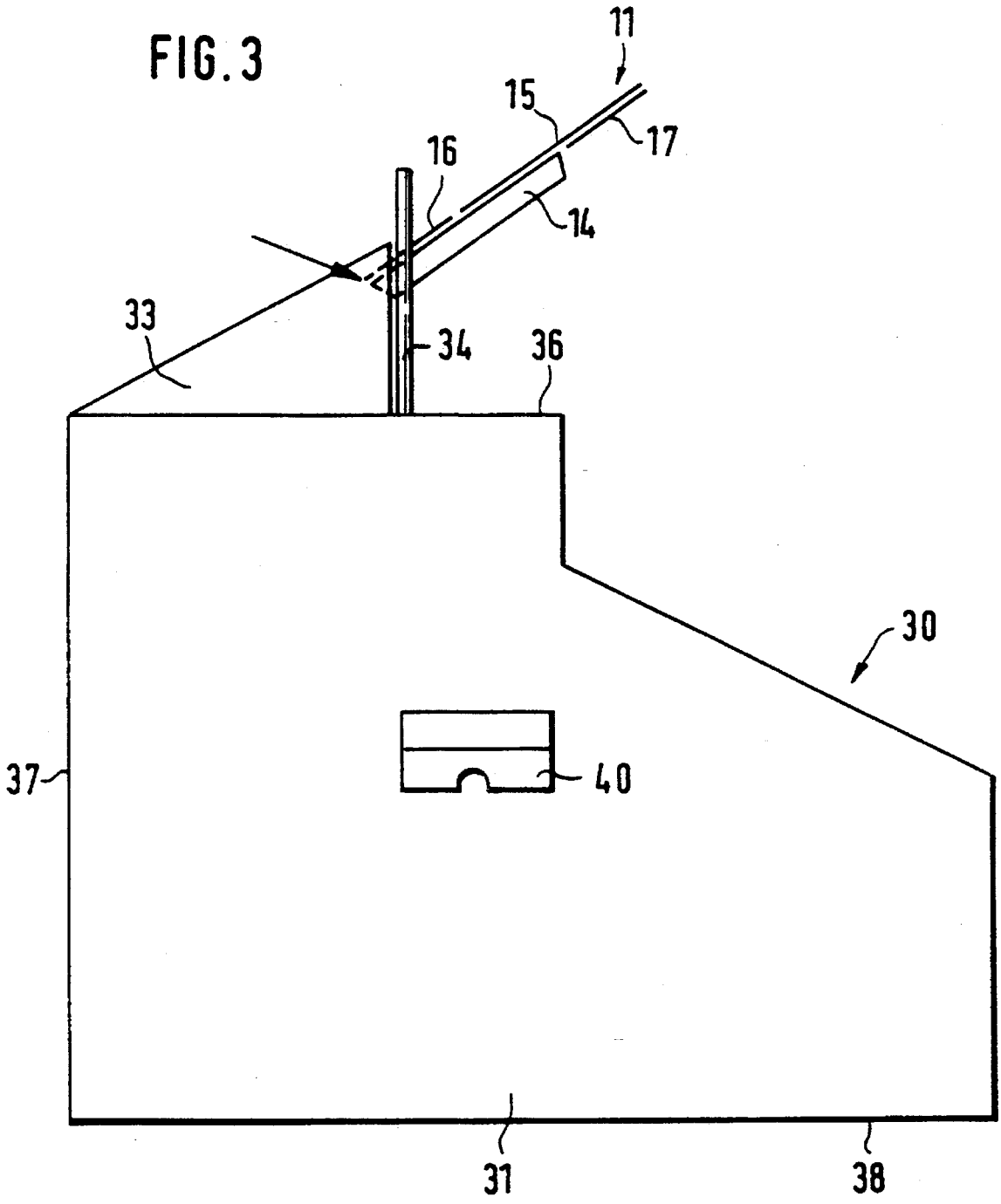
Figure 4:
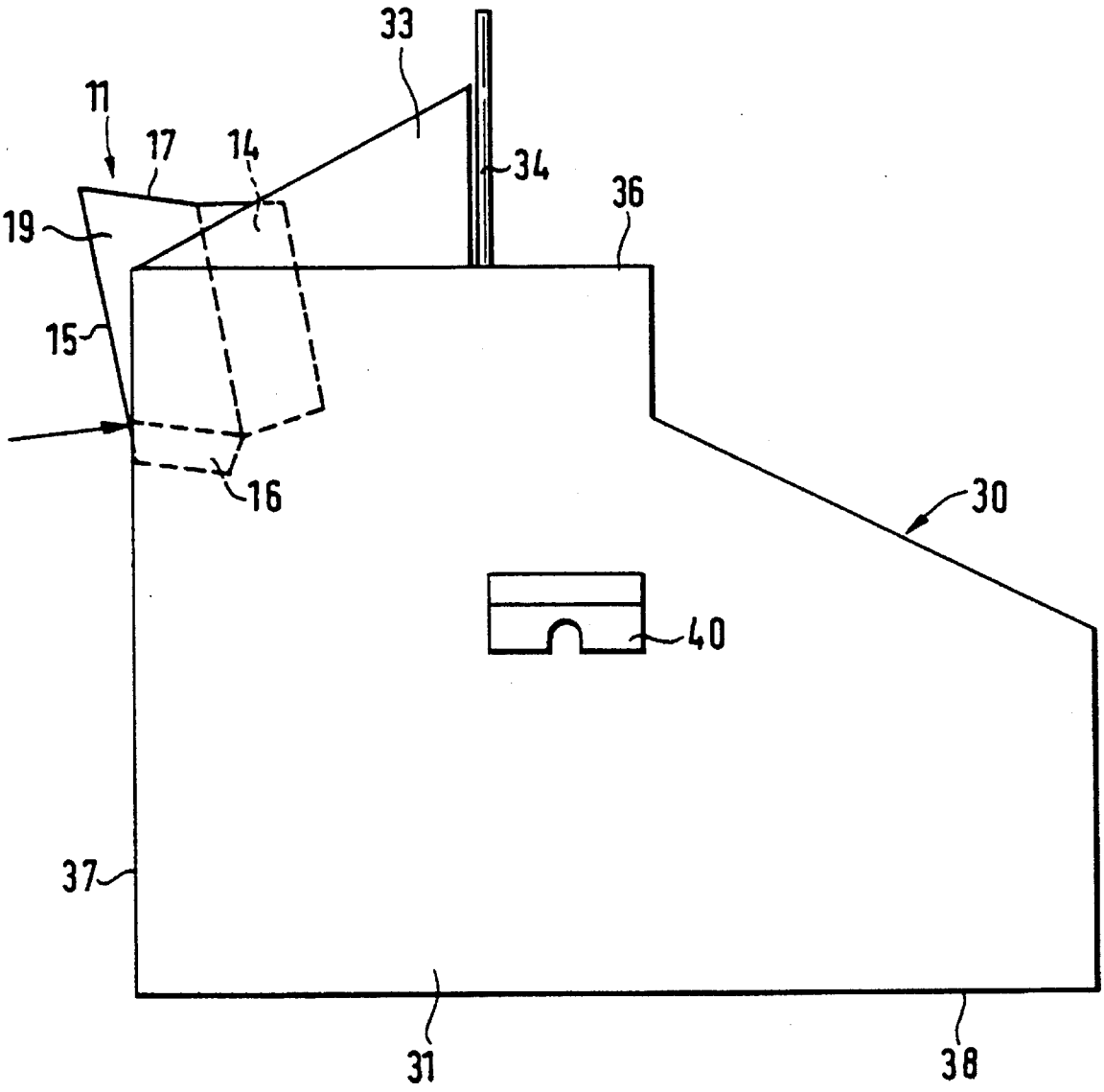
Figure 5:
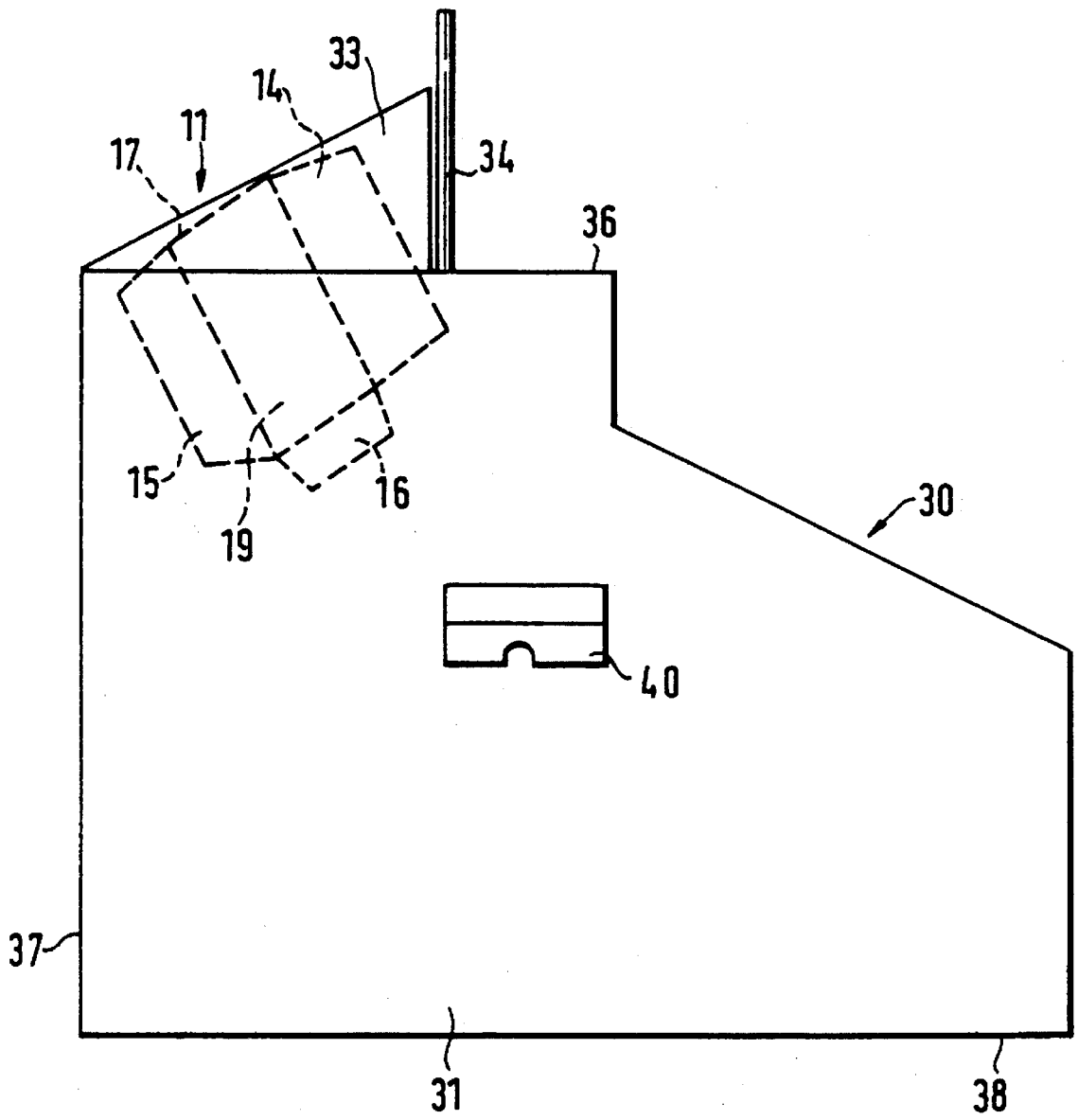
Figure 6:
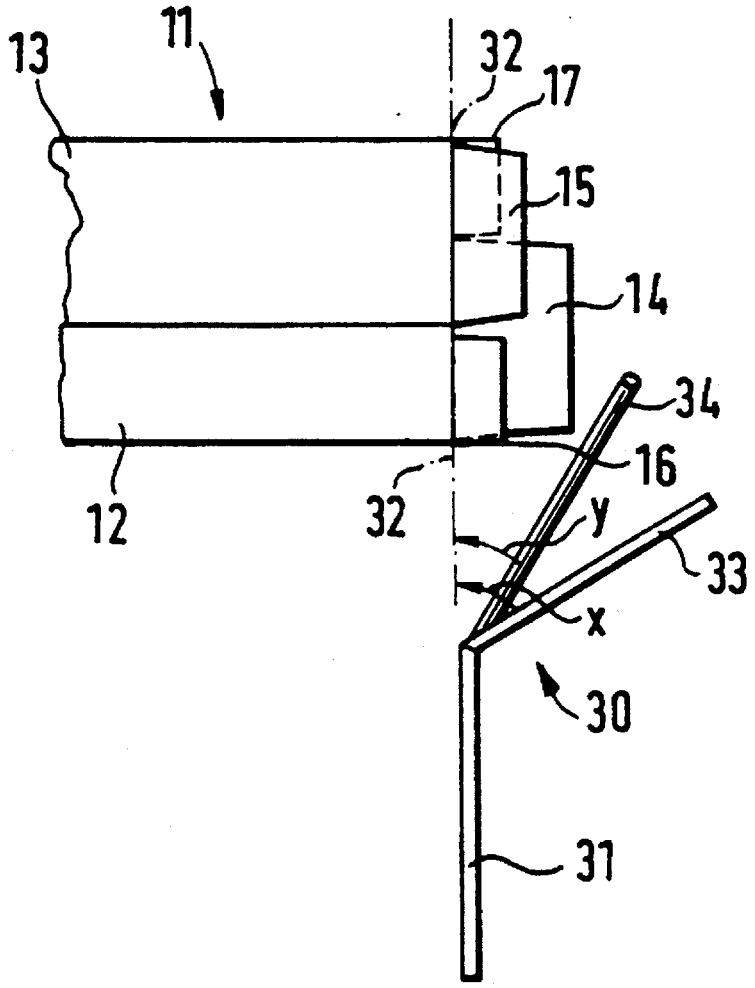
FIG. 6 shows the folder device of FIG. 2 in cross section, in the plane VI—VI of FIG. 2.

In a magazine 10, folding boxes 11, in their flat state, are stacked in reserve. Each folding box 11 has two narrow side walls 12 and two wide side walls 13, of which closure flaps 14–17 for closing an opening 19 in the erected folding box 11 protrude. A greater length cover flap 14 is located on the broad side 13 located at the front in the direction of the motion upon transfer of the folding box 11, while an oppositely disposed flap 15 that is of a lesser length is located on the rear broad side 13 in the direction of motion, and still further-recessed side flaps 16 and 17 protrude from the two narrow side walls 12; of these flaps, the one in the front in the direction of motion will be called the front side flap 16 and the one in the rear will be called the rear side flap 17.

One folding box 11 at a time is removed downward from the vertically disposed magazine 10, conveyed to a first curve, laterally protruding segment a, first to a turning point B and then to a second curved segment b to a turning point C; along the first segment a, the folding box 11 is moved by 90° into a perpendicular position, and on the second segment b it is put back into a horizontal position, in which the folding box 11 is inverted by 180° with respect to its original position. Along this path of motion, the folding box 11 is erected, and its closure flaps 14–17, which originally protrude from the side walls 12 and 13, are folded outward at a right angle, to the side walls thereby forming a fill opening 19.

For transfer of the folding boxes 11 from the magazine 10 into a conveyor device 20 of a cartoning machine, the apparatus by way of example has a transfer device 21 known from EP-A-0433667. This transfer device has a three-armed rotor 23, which is rotatably supported on a revolving crank 22, and on whose arms 25 holders 26 are disposed, uniformly staggered around the circumference. These holders 26 traverse a self-contained cycloidal orbit with the four turning points A, B, C and D. One turning point A is associated with the magazine 10 for the folding boxes 11 to be processed, and the turning point C opposite it is associated with the transfer point to the conveyor device 20 of the cartoning machine. It is also conceivable for the orbit to be made without the turning point D, so that the holders 26 return from the turning point C directly to the turning point A.

For manipulating a folding box 11, the holders 26 are subjected to negative pressure at the turning point A, so that a single folding box 11 is removed from the magazine 10. This negative pressure is maintained until the turning point C is reached, where the folding box 11 is transferred to the conveyor device 20 of the cartoning machine. A pivotable pressure prong 27 or holding-down finger is also associated with each arm 25; along the transfer path from the turning point A to the turning point C of the folding box 11, this pivatable pressure prong 27 presses on this folding box in a controlled manner, beginning shortly before the turning point B.

For folding the closure flaps 14–17 at the fill opening 19 of the folding box 11 during the transfer of the folding box 11, a folder device 30 is disposed stationary in the range of motion of the folding box, along its transfer path. The folder device 30 has a platelike folder element 31, which extends in the plane of motion of the folding lines 32 of the closure flaps 14–17 of the folding box 11, and two further folder elements 33 and 34, which protrude obliquely from the platelike folder element 31 into the range of motion of the closure flaps 14–17. The platelike folder element 31 covers part of the segment a and the entire segment b. It has an upper edge 36 parallel to the folding boxes 11 in the magazine 10; an edge 37 vertical thereto, near the turning point B, and a lower edge 38 parallel to the upper edge 36. The upper edge 36 extends approximately at the level of the turning point B, so that the rear side flap 17 and the lower flap 15, along their transfer path between the turning points A and B, always move above this edge 36. The lower edge 38 extends below the transfer path of the folding boxes 11 in the conveyor device 20. The vertical edge 37 is located in the vicinity of the turning point B, so that the lower flap 15, along its transfer path at the turning point B, is located outside the platelike folder element 31. At the upper edge 36, a triangular folder element 33, in the form of a segment, is bent out of the plane of motion of the fold lines 32 of the folding boxes 11 into the range of motion of the closure flaps 14–17. The triangular folder element 33 may, however, also be embodied in the form of stationary shunts or the like, in order to manipulate critical folding box formats. The angle of inclination x is such that the front side flap 16, along its transfer path between the turning points A and B, and the rear side flap 17, along its transfer path between the turning points B and C, run up against the triangular folder element 13 and are folded by it.

A preferably barlike folder element 34, which likewise protrudes into the range of motion of the closure flaps 14–17, is also disposed on the platelike folder element 31, vertically to the upper edge 36. Its angle of inclination y is smaller than that of the triangular folder element 33. Its disposition between the turning points A and B is selected such that the cover flap 14, along its transfer path between the turning points A and B, runs up onto the barlike folder element 34 and is folded, without the other closure flaps 15, 16 and 17 running up on that element.

A fastening hoop 40 mounted on the platelike folder element 31 serves to fasten the folder device 30 to the apparatus. When a format change is performed, the complete folder device 33 can thus be exchanged in a simple manner for another folder device, adapted to the different folding box format.

The apparatus described above functions as follows:

When a folding box 11 in the flat position is withdrawn from the magazine 10 by means of the holders 26 of the rotor 23, the cover flap 14 and the rear side flap 17, as well as the front side flap 16 and the lower flap 15, are each initially located in two parallel planes. The folding box 11 is then conveyed along the segment a and at the same time rotated by 90°.

Because of the arrangement of folder elements 31, 33 and 34 and because of the kinematics of the transfer device 21, the closure flaps 14–17 are folded, in the order of their disposition in the direction of motion of the folding box 11 to the folder elements 31, 33 and 34. Of two closure flaps 14–17 that cover one another and hence are parallel with respect to the motion to the folder elements 31, 33 and 34, the uppermost one of the closure flaps 14–17 is always folded first.

First, the cover flap 14 runs up against the barlike first folder element 34 and is gradually folded by it as a result of the motion of the folding box 11 to the folder element 34. As the second one of the closure flaps 14–17, the front side flap 16 runs up against the triangular second folder element 33 and begins to be folded at it. As the process continues, the cover flap 14 slides from the barlike folder element 34 onto the triangular folder element 33. Then the cover flap 14 and the front side flap 16 slide from the triangular folder element 33 onto the platelike folder element 31 and by it are bent at a right angle to their side walls 12 and 13. Shortly before reaching the first turning point B, the pressure prong 27 begins to erect the folding box 11, by pressure against a narrow side wall 12. At the turning point B, the folding box 11 has been partly erected, and its lower flap 15 is located outside the vertical edge 37. Over the ensuing segment b leading laterally downward, the lower flap 15 runs up against the vertical flap 37 and is bent at a right angle on it. As the process continues, the rear side flap 17 is the last to strike the triangular folder element 33; it begins to fold on it, and at the transition into the platelike folder element 31 is bent at a right angle thereby. All four side flaps 14–17 have now been bent at a right angle, uncovering the fill opening 19, and slide along the segment b on the platelike folder element 31.

At the turning point C, when the opened folding box 11 is inserted between a pair of drivers 41 of the conveyor device 20 of the cartoning machine, the conveyor device 20 takes on the task of further transporting the folding box 11 to a filling and closing apparatus, not shown. The folding boxes 11, with folded closure flaps 14–17, are guided over rails so that the fill apparatus is near the fill opening 19 of the folding box 11. Via two further curved segments c and d, the holders 26 return to the turning point A in order to remove the next folding box 11 from the magazine 10.

In a modification of the exemplary embodiment, folding boxes with three closure flaps can be manipulated in the apparatus, in that a cover flap and a first side flap are folded along the first segment a, and a second side flap is folded along the second segment b.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for removing a folded box (11) from a magazine and erecting the box from a folded condition to an open position in a cartoning machine simultaneously with bending closure flaps at right angles to sides of the box when the box is transferred between said magazine and a box conveying device, said box having side walls and first, second, third and fourth closure flaps (14–17) that are joined with said side walls along fold lines (32) in a same plane with the side walls of the folded box, which comprises engaging one of the folded boxes and transferring the folded box (11) along a transfer path composed of a plurality of fixed curved path segments (a–d) to erect the side walls and fold the flaps at a right angle to the side walls to erect the folded box, successively erecting the side walls and folding the first, second, third and fourth closure flaps (14–17), at right angles to the side walls (12, 13) along the fold lines in a continuous movement of said box thereby forming an opening (19) during erecting and transferring the folded box along the transfer path, successively folding the first, second, third and fourth closure flaps (14–17) to surround the opening (19) along the fold lines during movement of the box relative to stationary folder elements (31, 33, 34) during the erecting and transferring process between the removal of the folded box (11) from the magazine (10) and transfer of the box to the conveyor device (20) of the cartoning machine, wherein the first, second, third and fourth closure flaps (14–17) are folded in succession in the order of their arrangement in the direction of motion of the folded box (11) along the transfer path relative to the stationary folder elements (31, 33, 34), beginning with a lower closure flap, the lower closure flap is folded first outwardly at a right angle relative to the side walls with the remainder of the closure flaps folded at a right angle to respective side walls in succession.

2. A method as defined by claim 1, which comprises transferring and turning the folded box (11) along two curved path segments (a, b) joined together at a turning point (B); that along the first segment (a) the first closure flap is folded along a fold line at a first folder element (34) and the second closure flap is folded along a fold line at a second folder element (33); and that along the second segment (b) the third closure flap is folded along a fold line at the second folder element (33).

3. A method as defined by claim 2, in which the fourth closure flap is folded along a fold line at a platelike folder element (31) along the second segment (b).

4. An apparatus for erecting a folded box (11), said apparatus including a magazine for holding a plurality of folded boxes, each said folded box includes side walls and closure flaps that extend from said side walls which initially extend from fold lines in a plane with the side walls of the folded box, a rotatable transfer device (21) for transferring the folded box (11) from the magazine (10) along a transfer path onto a conveyor device (20) of a cartoning machine for conveying the erected box to a filling and closing station, said transfer path including a plurality of curved path segments (a–d) having at least one turning point (B), said plurality of curved path segments (a and b) including stationary folder elements (31, 33, 34) disposed along the transfer path of the folded box to be erected, said stationary folder elements includes a platelike folder element (31) which covers a great majority of the transfer path of the folded box (11) and is located in a plane of motion of the fold lines (32) of the closure flaps (14–17); said platelike folder element (31) has an upper edge (36) located below a first curved segment (a) of the transfer path of a lower flap of the folded box (11); a vertical edge (37) located in a vicinity of the turning point (B), and a lower edge (38) that extends below the transfer path of the folded box (11) in the conveyor device (20) of the cartoning machine; and the vertical edge (37) joins two edges (36 and 38) and is located slightly outside the turning point (B) of the plurality of curved path segments (a, b) of the transfer path, and further folder elements (33, 34) protrude into a path of motion of the closure flaps (14–17) and are disposed near the upper edge (36) of the platelike folder element (31).

5. An apparatus as defined by claim 4, in which the platelike folder element (31) and a triangular folder element (33) protrude into a range of motion of the closure flaps.

6. An apparatus as defined by claim 5, in which the platelike folder element and a barlike folder element (34) protrude into the range of motion of the closure flaps (14–17).

7. An apparatus as defined by claim 4, in which the platelike folder element (31) and a barlike folder element (34) protrude into the range of motion of the closure flaps (14–17).

* * * * *